US008794274B2

(12) United States Patent
Colnago

(10) Patent No.: US 8,794,274 B2
(45) Date of Patent: Aug. 5, 2014

(54) BEVERAGE VENDING MACHINE

(75) Inventor: Simone Colnago, Bergamo (IT)

(73) Assignee: N&W Global Vendings S.p.A, Valbrembo (IT)

( * ) Notice: Subject to any disclaimer, the term of this patent is extended or adjusted under 35 U.S.C. 154(b) by 0 days.

(21) Appl. No.: 13/549,802

(22) Filed: Jul. 16, 2012

(65) Prior Publication Data

US 2013/0180623 A1 Jul. 18, 2013

(30) Foreign Application Priority Data

Jul. 14, 2011 (IT) ..... TO2011A0620

(51) Int. Cl.
*B65B 43/42* (2006.01)
*G07F 13/10* (2006.01)

(52) U.S. Cl.
CPC ..... *G07F 13/10* (2013.01)
USPC ..... 141/174; 141/177; 141/279; 141/284

(58) Field of Classification Search
USPC ..... 141/97, 174, 177, 268, 279, 284
See application file for complete search history.

(56) References Cited

U.S. PATENT DOCUMENTS

| | | | | | |
|---|---|---|---|---|---|
| 1,885,368 | A | * | 11/1932 | McLellan | 141/165 |
| 3,000,408 | A | * | 9/1961 | Vischer, Jr. | 141/174 |
| 3,236,270 | A | | 2/1966 | Stutz | |
| 4,181,162 | A | * | 1/1980 | Newman et al. | 141/105 |
| 4,738,290 | A | * | 4/1988 | Ciekanski | 141/82 |
| 4,989,753 | A | | 2/1991 | Brogna et al. | |
| 5,261,467 | A | * | 11/1993 | Yamamoto et al. | 141/174 |
| 5,350,082 | A | | 9/1994 | Kiriakides, Jr. et al. | |
| 6,102,246 | A | | 8/2000 | Goulet et al. | |
| 6,742,553 | B2 | * | 6/2004 | Sato et al. | 141/174 |
| 7,308,916 | B2 | * | 12/2007 | Akuzawa et al. | 141/174 |
| 2005/0268638 | A1 | | 12/2005 | Voglewede et al. | |

FOREIGN PATENT DOCUMENTS

| | | | |
|---|---|---|---|
| DE | 2410053 | | 9/1975 |
| DE | 2410053 | A1 * | 9/1975 |
| EP | 1564696 | | 8/2005 |
| EP | 1564696 | A2 * | 8/2005 |
| WO | WO 94/25391 | | 11/1994 |

OTHER PUBLICATIONS

Italian Search Report from Italian Patent Application No. IT TO20110620 dated Jan. 17, 2012.

* cited by examiner

*Primary Examiner* — Timothy L Maust
(74) *Attorney, Agent, or Firm* — Dorsey & Whitney LLP

(57) ABSTRACT

A beverage vending machine is disclosed. The beverage vending machine includes a beverage production unit; a store containing cups; a take-out compartment; at least two cup-holders; and a beverage dispensing device. The take-out compartment is accessible from the outside and has at least two dispensing stations. Each of the at least two cup-holders is configured to support a cup at a respective dispensing station. The beverage dispensing device defines an outlet of the beverage production unit and is operated to selectively engage the dispensing stations.

8 Claims, 3 Drawing Sheets

BEVERAGE VENDING MACHINE

CROSS-REFERENCE TO RELATED APPLICATIONS

This application claims priority to Italian Application No. TO2011A000620 filed on 14 Jul. 2011, the contents of which are incorporated herein, in their entirety, by this reference.

TECHNICAL FIELD

Embodiments of the present invention relate to a beverage vending machine. More specifically, embodiments of the present invention relate to a beverage vending machine of the type comprising a beverage production unit; a cup store; a take-out compartment accessible from the outside; supporting means located in the take-out compartment and for receiving a cup from the store; and a beverage dispensing device defining an outlet of the beverage production unit and located over the supporting means to feed a beverage into a cup in the take-out compartment.

BACKGROUND

Vending machines of the above type generally produce a number of different beverages, normally including espresso coffee and various types of 'soluble' beverages, such as chocolate, tea, and broth.

Because of the variety of beverages produced, the need has arisen to employ cups of different types and sizes, depending on the selected beverage, i.e. a small cup for espresso coffee, and a larger cup for the other beverages.

Accordingly, vending machines of the above type are known, in which the cup store comprises two or more stores for respective types of cups; and the supporting means comprises two or more cup-holders, each designed to receive a respective type of cup from a respective store, and which are operated to move between respective cup-receiving stations and a shared dispensing station with a fixed dispensing device.

Since the dispensing station normally also functions as the user take-out station, which means the dispensing device is easily accessible from the outside and therefore exposed to vandalism, the dispensing device is normally protected by a guard operated to move to and from a guard position shielding the dispensing device, or is mounted to move between the dispensing station and a rest position inaccessible from the outside.

Though effectively solving the problem of employing cups of different sizes, the size and number of the moving parts involved in the above solution makes it unsuitable in cases requiring a particularly compact vending machine.

SUMMARY

It is an object of one or more embodiments of the present invention to provide a beverage vending machine of the above type designed to employ cups of different sizes, and which is compact and cheap and easy to produce.

According to an embodiment of the present invention, there is provided a beverage vending machine. The beverage vending machine includes a beverage production unit; a store containing cups; a take-out compartment accessible from the outside and having at least two dispensing stations; at least two cup-holders, each for supporting a cup at a respective dispensing station; and a beverage dispensing device, which defines an outlet of the beverage production unit and is operated to selectively engage the dispensing stations.

BRIEF DESCRIPTION OF THE DRAWINGS

A non-limiting embodiment of the present invention will be described by way of example with reference to the accompanying drawings, in which.

DETAILED DESCRIPTION

Figure 1:
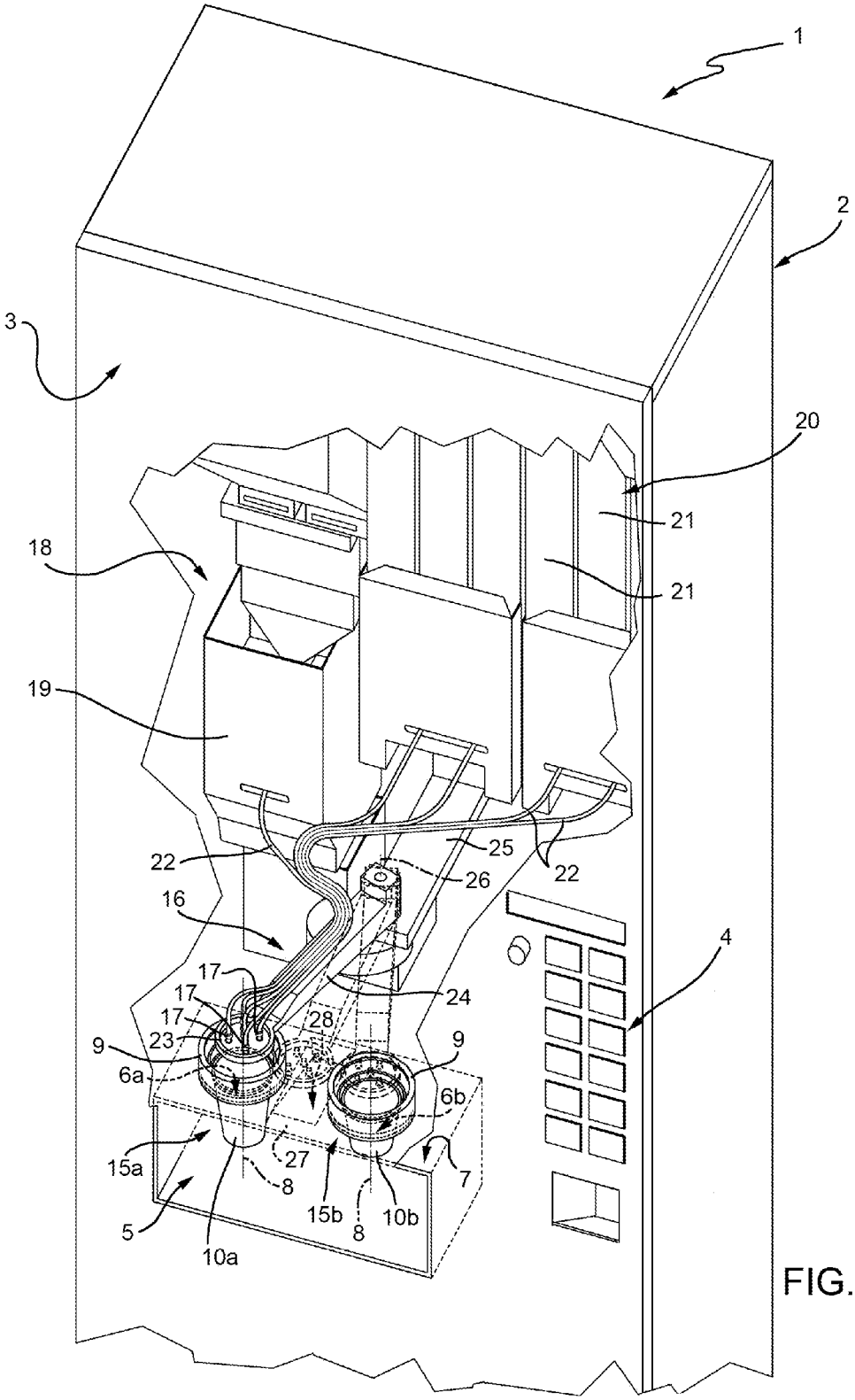
FIG. 1 shows a view in perspective, with parts removed for clarity, of a preferred embodiment of the vending machine according to the present invention.

Number 1 in FIG. 1 indicates as a whole a beverage vending machine comprising a cabinet 2 closed at the front by a door 3, which has a beverage selection panel 4, and a take-out compartment 5 accessible from the outside and from which the user removes a cup of the selected beverage.

Take-out compartment 5 communicates with the inside of cabinet 2 through two holes 6*a*, 6*b* formed in a top wall 7 of take-out compartment 5 and having respective substantially vertical axes 8.

Figure 2:
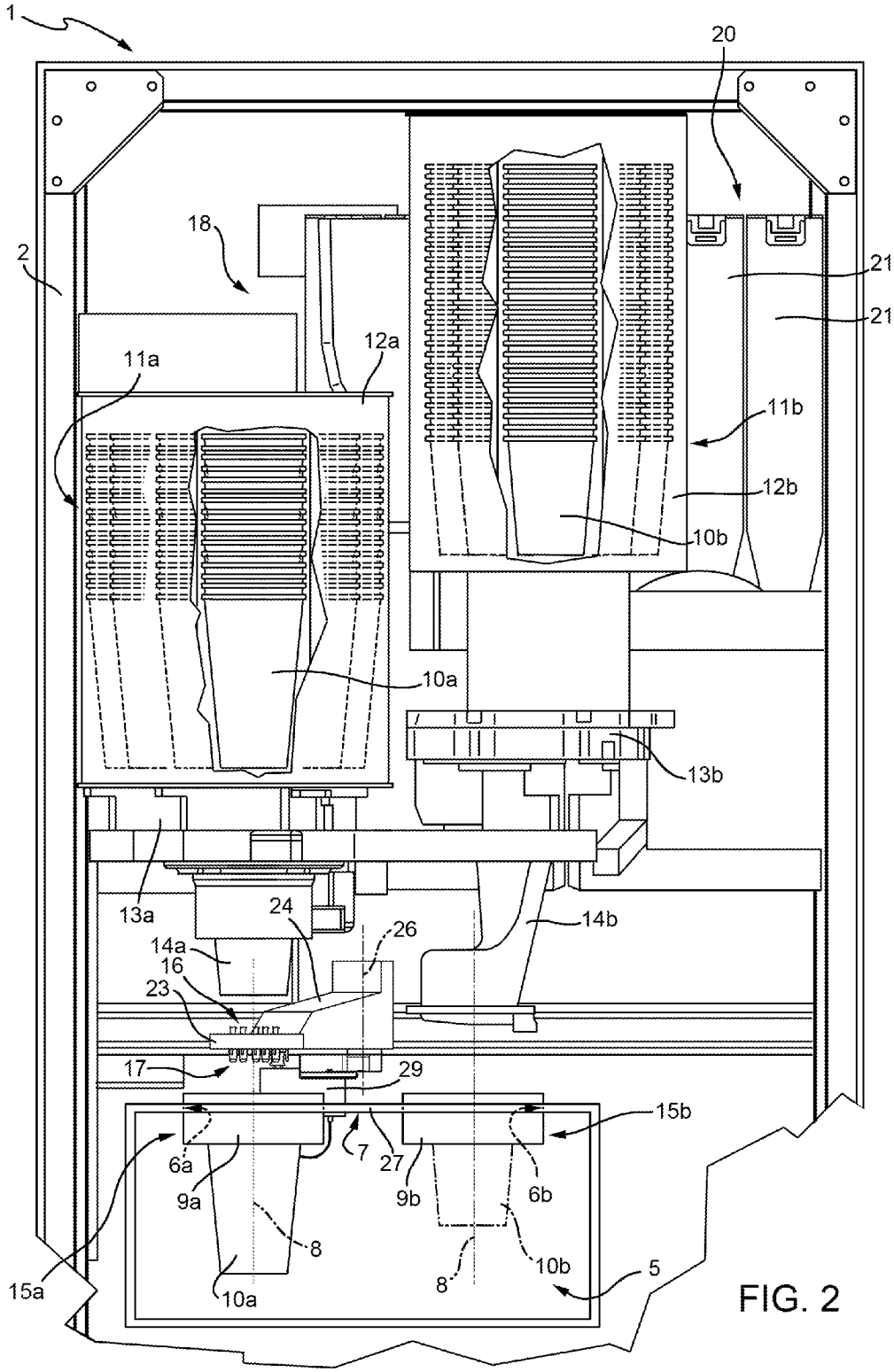
FIG. 2 shows a larger-scale front view, with parts removed for clarity, of a detail in FIG. 1.

As shown in more detail in FIG. 2, holes 6*a*, 6*b* are engaged axially by respective annular bodies 9*a*, 9*b*, which are coaxial with respective axes 8, have different inside diameters, and define two known cup-holders for respective cups 10*a*, 10*b* of different sizes (in the example shown, the larger cup is indicated 10*a*).

More specifically, each annular body 9*a*, 9*b* is designed to receive a respective downward-fed cup 10*a*, 10*b*, to support the cup 10*a*, 10*b* suspended firmly in an upright position inside take-out compartment 5, and to allow easy removal of cup 10*a*, 10*b* by the user extracting it downwards from annular body 9*a*, 9*b*.

As shown in FIG. 2, cups 10*a*, 10*b* are fed to respective annular bodies 9*a*, 9*b* from respective known stores 11*a*, 11*b*, which are mounted inside cabinet 2, over take-out compartment 5, and comprise respective hoppers 12*a*, 12*b*, each housing a number of stacks of respective cups 10*a*, 10*b*; and respective release devices 13*a*, 13*b*, each for withdrawing one cup at a time from the bottom of a respective stack of cups 10*a*, 10*b*.

On the side facing holes 6*a*, 6*b*, each release device 13*a*, 13*b* has a chute 14*a*, 14*b*, the outlet of which is coaxial with a respective axis 8, and is located over and a given distance from a respective hole 6*a*, 6*b*, so that a cup 10*a*, 10*b* released by respective release device 13*a*, 13*b* drops through hole 6*a*, 6*b* into respective annular body 9*a*, 9*b*.

In connection with the above, it should be pointed out that, to receive and support cups 10*a*, 10*b* inside take-out compartment 5, other supporting members may be substituted for annular bodies 9*a*, 9*b*, such as known fixed fork-shaped cup-holders, or movable supporting members such as known elevators movable between a raised position supporting cup 10*a*, 10*b* beneath respective hole 6*a*, 6*b*, and a lowered user take-out position.

Regardless of how cups 10*a*, 10*b* are supported in take-out compartment 5, holes 6*a*, 6*b* therefore define, inside take-out compartment 5, respective fixed dispensing stations 15*a*, 15*b* located directly beneath a dispensing device 16 and engageable selectively by dispensing device 16, depending on the type of beverage selected and, therefore, the type of cup 10*a*, 10*b* used.

As shown in FIG. 1, dispensing device 16 comprises a number of nozzles 17, which form the end portion of a production unit 18 housed inside cabinet 2 and for dispensing the liquid components of the user-selected beverage through nozzles 17.

In the example shown, production unit 18 is fitted to a rear wall of cabinet 2, and comprises a known brewing assembly 19 for producing coffee; and an assembly 20 for producing beverages from soluble powdered ingredients, such as chocolate, tea and milk. Assembly 20 comprises, in known manner, a number of hoppers 21 for the soluble ingredients; and a number of known mixers (not shown), in which the soluble ingredients are dissolved in water to produce respective beverages. Brewing assembly 19 and the mixers (not shown) are connected to dispensing device 16 by respective hoses 22, each extending from the outlet of brewing assembly 19 or a respective mixer to an inlet fitting of a respective nozzle 17.

Obviously, the composition and number of component parts of production unit 18 described with reference to the attached drawings are purely indicative, and may vary, depending on the requirements and intended use of machine 1.

Nozzles 17 are fitted to a support defined by a plate 23 located in an intermediate position between top wall 7 of take-out compartment 5 and chutes 14*a*, 14*b*, and which is hinged by an arm 24 to a bracket 25, integral with cabinet 2, to swing about a substantially vertical axis 26 and move nozzles 17, in a substantially horizontal plane, between two dispensing positions, in which nozzles 17 face one or the other of holes 6*a*, 6*b* and engage respective dispensing station 15*a*, 15*b*, and a normal intermediate rest position between the two dispensing positions.

Figure 3:
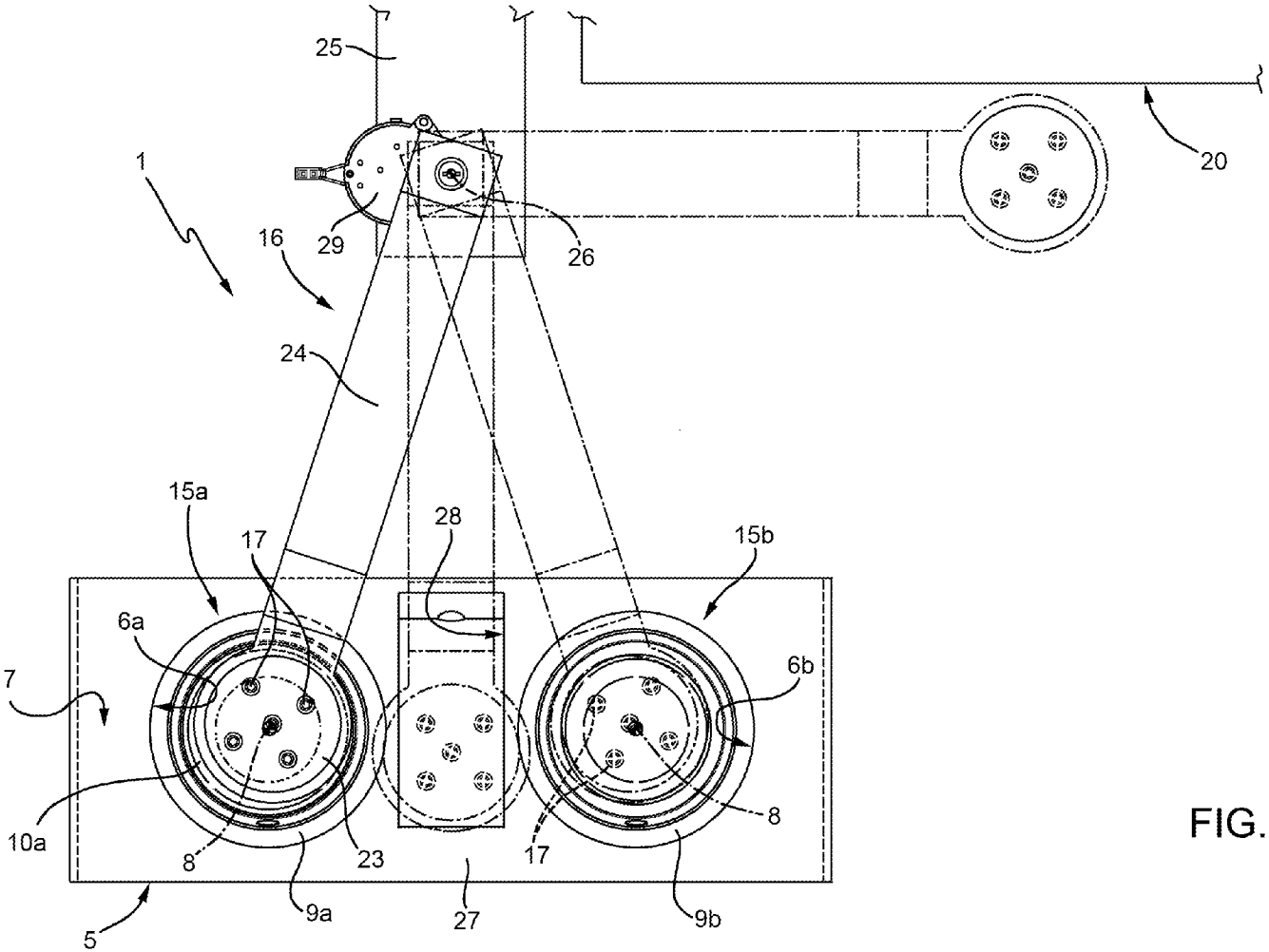
FIG. 3 shows a larger-scale plan view, with parts removed for clarity, of a detail in FIG. 2.

More specifically, and as shown in more detail in FIG. 3, plate 23 in the rest position faces a portion 27 of top wall 7 between holes 6*a* and 6*b*, so as not to interfere with cup 10*a* or 10*b* being fed into respective annular body 9*a*, 9*b*.

Portion 27 of top wall 7 also provides for shielding nozzles 17, by making them inaccessible from the outside and therefore vandal-proof in the rest position.

A tray 28 is preferably formed on or fitted to portion 27 to catch any drips from nozzles 17 at the end of the dispensing stage, and to feed the collected liquid, preferably by means of a drain tube (not shown), into a removable container (not shown) inside cabinet 2.

Arm 24 supporting plate 23 is rotated by a reversible electric actuator 29 fitted to bracket 25 and connected electrically to limit stop detecting devices (not shown), such as microswitches, for signalling the dispensing and rest positions of nozzles 17.

As shown in FIG. 3, when machine 1 is out of service, arm 24 can be rotated manually about axis 26 into a full-back position to clear the field for maintenance and cleaning.

In actual use, rotation of dispensing device 16 by electric actuator 29 is controlled by an electronic central control unit (not shown) connected to electric actuator 29, selection panel 4, production unit 18, and release devices 13*a*, 13*b*.

Depending on the beverage selected by the user, the central control unit commands release of a cup 10*a* or 10*b*, and, once this is seated inside respective annular body 9*a*, 9*b*, commands electric actuator 29 to rotate arm 24 about axis 26 and move nozzles 17 from the rest position to the dispensing position corresponding with the dispensing station 15*a*, 15*b* engaged by the selected cup 10*a*, 10*b*.

Once the dispensing stage is completed, electric actuator 29 is operated to rotate arm 24 in the opposite direction and return nozzles 17 to the rest and drip position.

In connection with the above, it should be pointed out that dispensing device 16 can also be used in machines 1 with more than two types of cups and dispensing stations.

In fact, in the event (not shown) of more than two dispensing stations aligned along an arc of a circle coaxial with axis 26, the angular travel, described above, of arm 24 about axis 26 need simply be modified to move nozzles 17 selectively into any of the dispensing stations. In the event (not shown) of more than two dispensing stations aligned, for example, in one or more rows, as opposed to an arc of a circle coaxial with axis 26, dispensing device 16 is modified to enable nozzles 17 to move not only about but also crosswise to axis 26, e.g. by means of a telescopic arm 24.

The invention claimed is:

1. A beverage vending machine comprising:

a beverage production unit;

storage means for storing a number of cups;

a take-out compartment accessible from the outside;

supporting means for receiving a cup from the storage means; and a beverage dispensing device defining an outlet of the production unit and located over the supporting means to feed a beverage into a cup inside the take-out compartment, the beverage dispensing device comprising a number of nozzles, which are connected fluidically to respective outlets of the beverage production unit and are fitted to a movable common supporting body;

wherein the take-out compartment has at least two fixed dispensing stations;

wherein the supporting means comprises, for each of the at least two fixed dispensing stations, a respective cup-holder for supporting a cup at the dispensing station;

wherein the beverage dispensing device is operated to selectively engage the at least two fixed dispensing stations.

2. The beverage vending machine as claimed in claim 1, wherein the cup-holders are designed to support cups of respective different sizes; the storage means being designed to house cups of different sizes, and being controlled to feed a cup of a given size to the respective cup-holder, depending on the beverage selected by the user.

3. The beverage vending machine as claimed in claim 1, wherein the take-out compartment has a top wall with a through opening at each of the at least two fixed dispensing stations; each of the openings connecting the take-out compartment to the inside of the machine, and allowing a cup to be fed into the respective cup-holder.

4. The beverage vending machine as claimed in claim 3, wherein the beverage dispensing device is located above the top wall, and is movable between a number of dispensing positions, in each of which the beverage dispensing device is located at one of the at least two fixed dispensing stations and positioned facing the respective opening, and a normal rest position, in which the beverage dispensing device is positioned clear of the openings, so as not to interfere with the cups being fed through the openings.

5. The beverage vending machine as claimed in claim 4, wherein the beverage dispensing device is inaccessible from the outside in the rest position.

6. The beverage vending machine as claimed in claim 4, further comprising collecting means for collecting drips from the beverage dispensing device; the beverage dispensing device facing the collecting means in the rest position.

7. The beverage vending machine as claimed in claim 1, wherein the movable-common supporting body is mounted to swing about a fixed, substantially vertical axis.

8. The beverage vending machine as claimed in claim 1, further comprising actuating means for operating the beverage dispensing device; the actuating means being controlled to control movement of the beverage dispensing device to one or other of the at least two fixed dispensing stations, depending on the type of beverage selected by the user.

* * * * *